US007015814B2

(12) United States Patent
Ireland et al.

(10) Patent No.: US 7,015,814 B2
(45) Date of Patent: Mar. 21, 2006

(54) SECURITY TAG

(75) Inventors: Phillip Michael William Ireland, Hampshire (GB); David Alan Brooks, Hampshire (GB); Raglan Horatio Andrew Harold Tribe, Hampshire (GB); Pietro Armanini, Hertfordshire (GB)

(73) Assignee: De La Rue International Limited, Basingstoke (GB)

( * ) Notice: Subject to any disclaimer, the term of this patent is extended or adjusted under 35 U.S.C. 154(b) by 46 days.

(21) Appl. No.: 10/432,033

(22) PCT Filed: Nov. 29, 2001

(86) PCT No.: PCT/GB01/05267

§ 371 (c)(1),
(2), (4) Date: Jun. 11, 2003

(87) PCT Pub. No.: WO02/45042

PCT Pub. Date: Jun. 6, 2002

(65) Prior Publication Data

US 2004/0113792 A1 Jun. 17, 2004

(30) Foreign Application Priority Data

Dec. 1, 2000 (GB) ..... 0029392

(51) Int. Cl.
*G08B 13/14* (2006.01)

(52) U.S. Cl. ..... 340/572.1; 340/572.4

(58) Field of Classification Search ..... 340/572.1, 340/572.3, 572.4, 572.7, 573.4, 539.1, 539.12, 340/539.23, 686.8, 825.36, 10.41, 10.5, 686.6
See application file for complete search history.

(56) References Cited

U.S. PATENT DOCUMENTS

| | | | | |
|---|---|---|---|---|
| 5,032,823 A * | 7/1991 | Bower et al. | ..... | 340/572.8 |
| 5,245,317 A * | 9/1993 | Chidley et al. | ..... | 340/571 |
| 5,367,289 A | 11/1994 | Baro et al. | ..... | 340/572.8 |
| 5,396,227 A * | 3/1995 | Carroll et al. | ..... | 340/825.36 |
| 5,650,770 A | 7/1997 | Schlager et al. | ..... | 340/573.1 |
| 5,793,290 A * | 8/1998 | Eagleson et al. | ..... | 340/573.4 |
| 5,955,951 A | 9/1999 | Wischerop et al. | ..... | 340/572.8 |
| 6,002,343 A | 12/1999 | Auerbach et al. | ..... | 340/572.1 |
| 6,229,442 B1 * | 5/2001 | Rolin et al. | ..... | 340/572.1 |
| 6,255,958 B1 * | 7/2001 | Haimovich et al. | ..... | 340/686.6 |

FOREIGN PATENT DOCUMENTS

WO WO 00/16284 A1 3/2000

* cited by examiner

*Primary Examiner*—Van T. Trieu
(74) *Attorney, Agent, or Firm*—Oliff & Berridge, PLC

(57) ABSTRACT

A method of transferring ownership of item(s) includes securely identifying the item(s) by attaching a security tag to the item(s). The security tag has a monitoring system for monitoring a tag status, the tag status indicating whether the security tag and/or the item(s) have been tampered with. The method includes detecting remotely a condition of the monitoring system and causing a remote host to register a change in ownership of the item(s) when the monitoring system does not indicate a tampered condition.

14 Claims, 3 Drawing Sheets

SECURITY TAG

FIELD OF THE INVENTION

The present invention relates to a security tag for securely identifying items, and methods for using such tags.

BACKGROUND

Security tags are used commonly with articles of merchandise, particularly clothing and the like, to prevent unauthorised removal of such articles. These tags are usually securely connected to the items and an interrogation system is located at the exit to a retail store or the like which can detect the passage of a tag and initiate an alarm. Tags are also known for securing an article or item in place and providing an indication if the tag or the article becomes detached.

A variety of security tag systems are described in the prior art. WO-A-00/16284 describes a card to which a key can be securely attached via a tether which is electrically conductive so that its condition can be monitored when the card is fixed to a separate monitoring system. In another embodiment, the card is attached to a flexible bag having electrically conductive wires whose condition can be monitored so that an attempt to break into the bag can be detected. The drawback of this device is the need for permanent attachment to the monitoring system.

U.S. Pat. No. 6,002,343 discloses an electronic tag which can be affixed to an object via a resistive element whose electrical resistivity is monitored by an on-board processor with information being transmitted to a separate detection system if the monitoring indicates that the resistive element has been compromised. This leads to a more flexible system than that described above but does not address attempts which may be made by sophisticated attackers to attack the tag itself.

U.S. Pat. No. 5,367,289 discloses an electronic article surveillance tag which would typically be connected to clothing or the like and which includes a piezoelectric film which generates a voltage when subject to mechanical forces. The tag includes an alarm which is activated if the voltage exceeds a reference. This device has been developed to detect an attempt to detach the tag from the article but in fact achieves this by looking for the application of forces to the tag. The tag could be detached from the article without activating the alarm by carefully severing the connection to the article.

GB-A-2257278 describes an anti-pilferage tag including a microcircuit to enable data communication between the tag and a host computer. Although there is brief mention of some form of tamper detection, the prime purpose of the tag is to enable the location of stock to be monitored.

U.S. Pat. No. 5,099,228 describes a security tag which can be attached to an article of merchandise by means of a tack and including a sensor for sensing the presence of the head of the tack. An attempt to tamper with the tack will therefore be detected.

U.S. Pat. No. 5,955,951 discloses another type of tag/tack arrangement.

WO-A-98/15921 describes a security system for use at a transport terminal, the system including an electronic passenger tag including a memory and a wireless communication device, the memory storing a unique passenger identification code in a tamper proof manner; and an electronic luggage tag having a wire memory and a wireless communication device. In this way, the tags can be uniquely registered with one another.

U.S. Pat. No. 6,052,068 describes a vehicle identification system including a set of vehicle identification tags which are attached to vehicles and which communicate with an interrogator to enable the vehicle identification to be determined.

There is a need to improve such security tags and we have developed a new security tag which in turn leads to novel methods of use for such a security tag.

In accordance with a first aspect of the present invention, we provide a security tag for securely identifying item(s), the security tag comprising:

a. A housing;

b. A securing mechanism for securing the housing to the item(s);

c. A monitoring system for monitoring a tag status, the tag status indicating at least whether the housing and the securing mechanism have been tampered with;

d. A store for storing item data, the item data identifying the item(s); and, e. A communication system adapted to communicate the tag status and the item data to a remote host.

In accordance with a second aspect of the present invention, we provide a method of securely identifying and monitoring item(s), the method comprising:

a. Attaching a security tag according to the first aspect of the invention to the item(s), the security tag having:

b. Storing item data identifying the item(s) in the store; and, c. Monitoring the tag status and/or the item data from a remote host via the communication system.

We have realised that each security tag of the prior art suffers from one or more of a number of disadvantages and have devised a new security tag which overcomes all these disadvantages. In particular, the tag includes an on-board monitoring system so that tampering is detected immediately and not only when the tag is interrogated by a remote host; and in addition the monitoring system monitors not only the securing mechanism by which the tag is secured to an item but also the condition of the housing itself. Thus, all types of tampering relating to the tag can be detected in contrast to the prior art.

In addition, where the item or a container enclosing the item is suitable, tampering of the item or container can also be monitored.

Although the tag could be remotely powered, for example from a main supply to a GSM/satellite module connected to the tag allowing long distance communication, in the preferred arrangement, the tag includes an on-board power supply. This provides another advantage of having an on-board monitoring system in that use of power from the power supply can be minimized. In addition, any external connection could provide an access point for any person trying to defeat the system. The tag when closed during manufacture would never be reopened unless for service or during attack. Being fully enclosed it makes the system much more resistant to any attack and removes any direct electrical connection to the internal components of the tag.

In use, if the monitoring system detects tampering, it can initiate a communication with a remote host via the communications system and typically this will include information about the tag status i.e. the fact that it is being tampered with as well as item data identifying the item concerned. The provision of an on-board monitoring system enables tampering to be detected at a very early stage and to be communicated with the remote host thus enabling remedial action to be taken as soon as possible. This makes the security tag particularly suitable for use with valuable item (s) such as articles of value including coins and banknotes.

Monitoring the condition of the housing provides an early indication of an attempt to tamper with the security tag which can be communicated to the remote host. This also prevents thieves from being able to damage the tag so as to stop the remote host from detecting that item(s) have been stolen. In one example, the housing can include a conductive portion with the monitoring system being adapted to monitor the electrical properties of the conductive portion to thereby determine the integrity of the housing. Thus, for example, if somebody pierces the housing in an attempt to destroy the internal workings of the security tag, then there will be a change in the electrical properties, such as the impedance, of the conductive portion which can be detected by the housing detector.

In an alternative example, the housing includes piezoelectric material and the monitoring system is adapted to monitor the electrical potential across the piezoelectric material to determine the integrity of the housing. Again, if somebody attempts to interfere with the housing this will generally cause vibrations which will in turn cause the piezoelectric material to generate a potential. This potential can be detected by the monitoring system so that again tampering with the housing is detected.

The monitoring system preferably includes an item detector to detect the integrity of the item(s). This may not be required however if the security tag is attached to a secure container, such as a safe, or the like.

Typically the item(s) are enclosed within a conductive enclosure in which case the item detector is adapted to monitor the electrical properties of the conductive enclosure to determine the integrity of the item(s). In this case, cash (coins and/or banknotes) could be placed for example in a bag in which wires are interwoven with the bag fabric. The conductivity of the bag would then be altered if an attempt was made to pierce the bag to extract the contents. Thus, this would allow the security tag to detect any attempt to remove item(s) from the bag.

Preferably the securing mechanism comprises a conductive member for securing the housing to the item(s). In this case, the monitoring system includes a mechanism detector adapted to monitor electrical properties of the conductive member to thereby determine the integrity of the securing mechanism.

The securing mechanism can include a piezoelectric material. In this case, the monitoring system may include a mechanism detector adapted to monitor the electrical potential across the piezoelectric material to determine the integrity of the securing mechanism.

As a further option, the securing mechanism could include a fine wire film, properties of which could be monitored by the monitoring system using a RF field applied to the film.

The securing mechanism usually includes an identification mark-up which can be associated with an indication of the item(s). This allows an additional amount of security to be provided.

The housing is usually formed from a tamper resistant material such as a lamination of rubber in a reinforced plastic as this is extremely difficult to tamper with. However, other high strength impact resistant materials can also be used.

In addition to this the housing usually includes a metal cage to protect at least the store, and also any other delicate electronic components. The metal cage will act as a Faraday cage to protect any delicate components included in the tag from EMP (electro magnetic pulse) attack.

The communication system may be any one of a number of communication systems, such as radio, infra-red, inductive or magnetic communication systems. Thus, for example, the communications system may comprises a Bluetooth type radio system. Alternatively inductive loop couplings may be provided so that when the security tag is brought in the vicinity of a reader, the tag status and some data can be read out from the store via an inductive loop.

Typically the communications system is adapted to encrypt the tag status and/or the item data prior to transfer to the remote host, for example using a PKI encryption system. This prevents third parties generating their own tag status and item data to mask the tag status of the genuine tag.

The communication system is preferably adapted to communicate with the remote host system on at least one of the following occasions:

i. At predetermined time intervals;

ii. Upon request from remote host systems; or, iii. Upon a change in tag status indicating that the security tags and/or the item(s) have been tampered with.

It will be realised that a number of other options are available, such as allowing the communication system to communicate with the remote host every time it reaches a predetermined location, or only on one type of occasion (i-iii) mentioned above.

Conveniently, therefore, the security tag includes a location detector for detecting the location of the tag, the tag status including an indication of the tag location. This allows the location of the tag to be tracked as the item(s) are moved around.

Currently, if it is desired to transfer ownership of items from one party to another, it is necessary to actually physically move the items from the transferor to the transferee. This process can be subject to risk, particularly if the items have a high value, such as for example banknotes. Typically in these situations, the items are secured within a locked container which is then moved by a security company or the like under secure conditions.

In order to increase the security of such systems, the security companies typically use timed locks to ensure that the items cannot be removed from the container for a predetermined time interval. This may be achieved for example by locking the container in a security van in such a way that the container can only be removed at a predetermined point in time which corresponds to the time at which the driver will reach the desired destination.

In addition to this, it is now possible to track the location of the containers and the vans so that the current location of the container and hence the items can be monitored.

However, such systems suffer from the drawback that it is still possible for the items to be stolen whilst in transit. Thus, for example the container can be removed from the van forcibly, or alternatively the van can be stolen and the container removed at the correct time at a different location. Although the location of the container in the van can be tracked, it is still possible to remove the items from the container without this being detected, thereby allowing the items to be stolen.

In accordance with a third aspect of the present invention, a method of transferring the ownership of item(s) comprises:

a. Securely identifying the item(s) by attaching a security tag to the item(s), the security tag having a monitoring system for monitoring the tag status, the tag status indicating whether the security tag and/or the item(s) have been tampered with;

b. Detecting remotely the condition of the monitoring system; and c. Causing the remote host to register a change in ownership of the item(s) when the monitoring system does not indicate a tamper condition.

The third aspect of the present invention recognises that once the item(s) have been secured, the ownership of the item(s) can be transferred even if the item(s) are not. In addition, the item(s) can be kept under less secure conditions.

Thus, for example, a shop owner may place money taken at the shop in a suitable container and then attach a security tag, as outlined above. At this point, the cash in the container is securely identified. Ownership of the contents of the container can then be transferred to the shop owner's bank, or the like, by registering a change in ownership at the remote host. From this point, the money is effectively owned by the bank which then has responsibility for the money. However, the container remains physically at the same location.

If at any stage the item(s) or the tag is tampere en an indication of this can be transferred to the remote host, such as a central control centre, which can identify that there is a security problem. This provides the owners with full traceability of the current status of the item(s) so that the owners can be confident that the item(s) are being transferred securely.

It will be realised that as soon as ownership of the money has been transferred, the money can be credited into the shop owner's bank account, allowing the shop owner to make transactions on the account in respect of the money which is still held on the premises. This is because the bank can account for the exact location and security of the money at all times.

Should the shop owner subsequently require cash from the bank, the shop owner can then simply arrange for ownership of the money to be transferred back, allowing the shop owner to retrieve the cash from the container in accordance with the bank's instructions. Accordingly, whilst the cash has been owned by the bank for a period of time, it has never left the shop premises. This therefore allows ownership of item(s) to be transferred without the item(s) themselves having to be moved which in turn helps reduce security risks.

Although the method can be used with conventional security tags, it is particularly suitable for use with security tags according to the first aspect of the invention in view of the high security which those tags can achieve. The third aspect of the invention is particularly suitable for use with articles or documents of value such as banknotes and coins.

BRIEF DESCRIPTION

An example of the present invention will now be described with reference to the accompanying drawings, in which.

Figure 1:
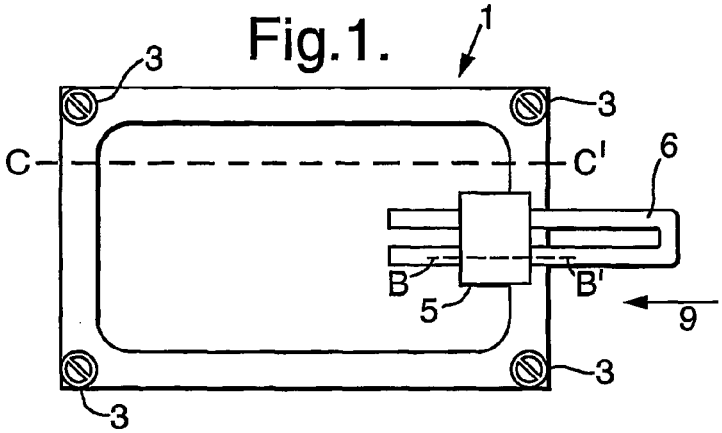
FIG. 1 is a plan view of a security tag according to the present invention.
Figure 3A:
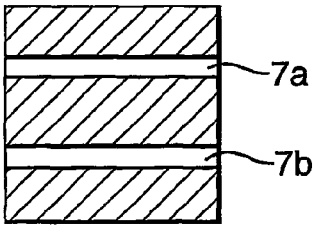
Figure 3B:
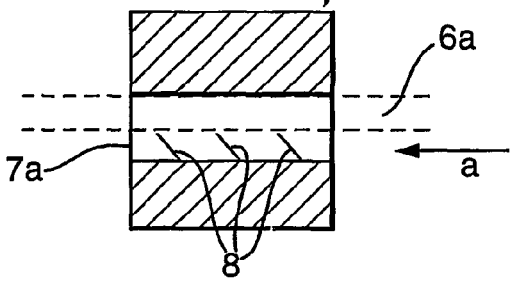
Figure 4:
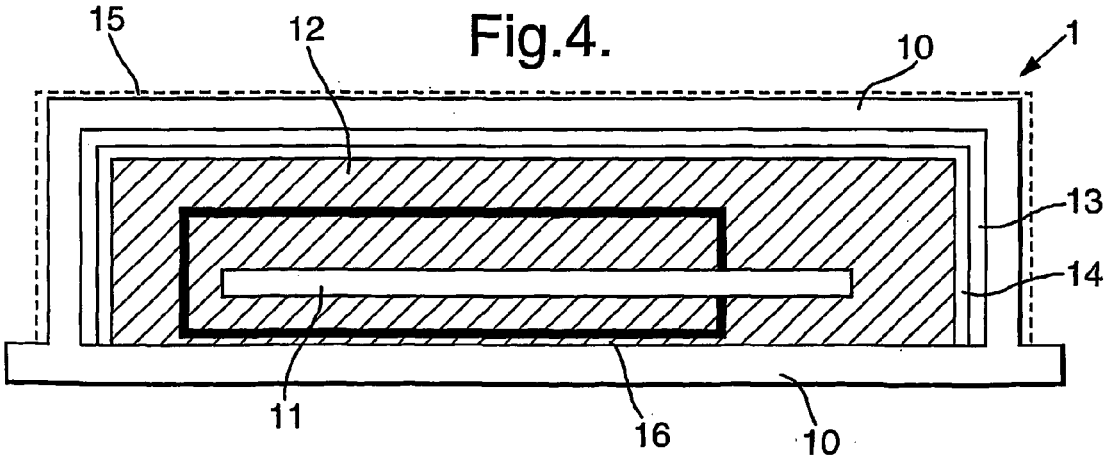
Figure 5:
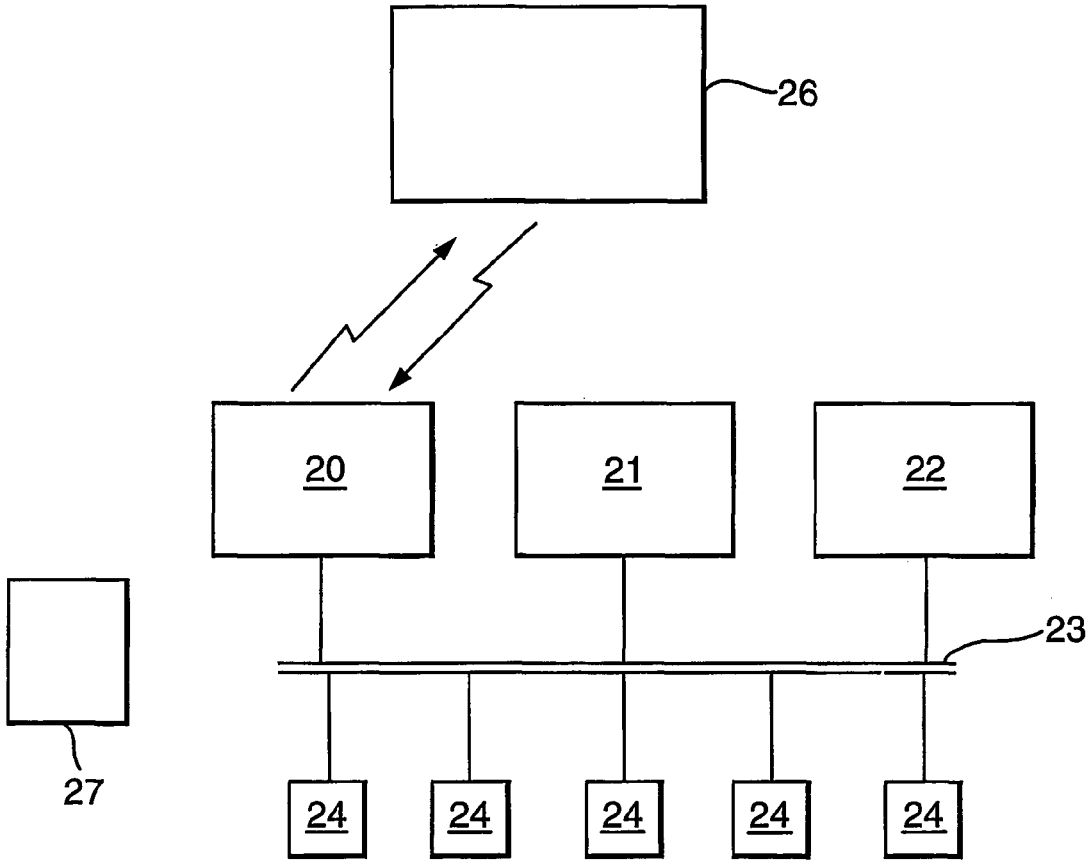
Figure 8:
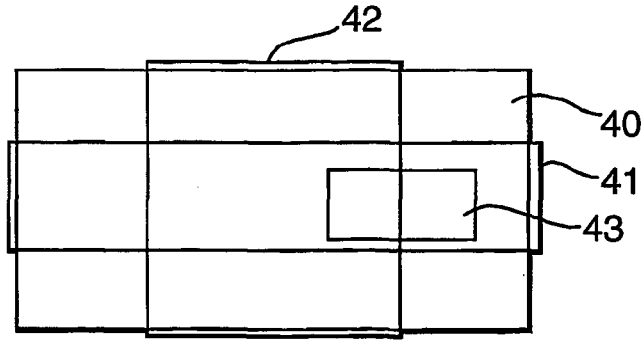
Figure 6:
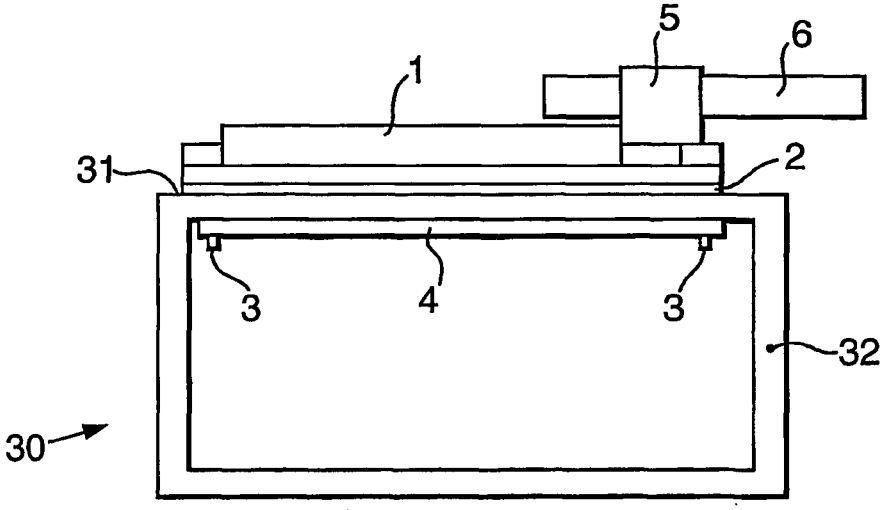
Figure 7:
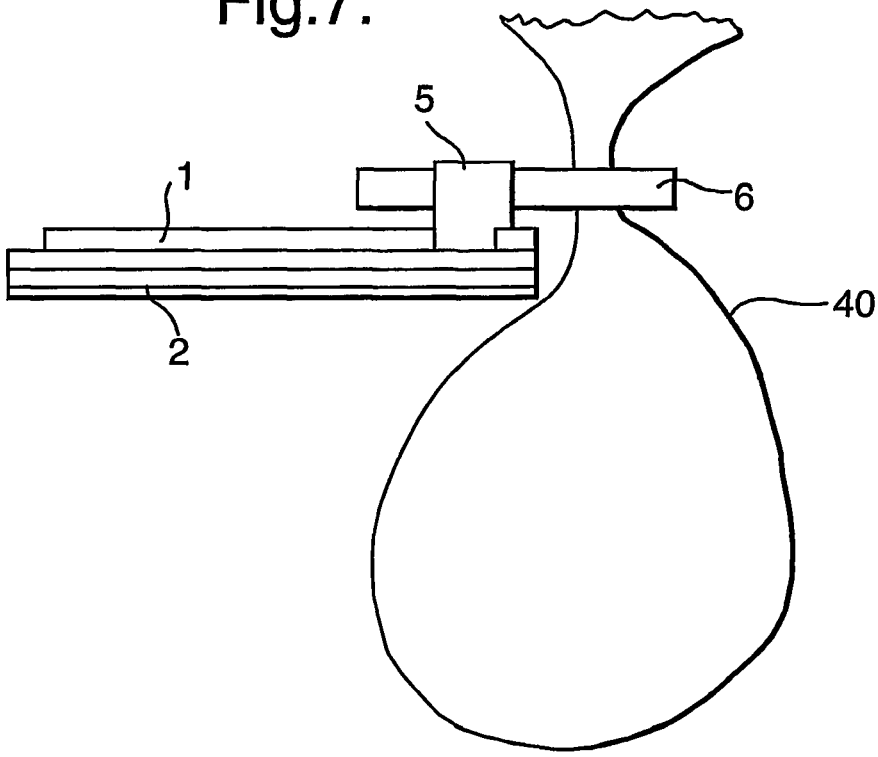

FIG. 3*a* is a cross-sectional view of the mounting of the security tag of FIG. 1 along the line A–A';

FIG. 3*b* is a cross-sectional view of the mounting of FIG. 3*a* along the line B–B';

FIG. 4 is a cross-sectional view of the security tag along the line C–C';

FIG. 5 is a schematic diagram of the internal components of the security tag of FIG. 1;

FIG. 6 is a schematic diagram showing the security tag of FIG. 1 attached to a solid container;

FIG. 7 is a schematic diagram of the security tag of FIG. 1 fitted to a fabric container; and, FIG. 8 illustrates a wrapped pack of banknotes attached to a security tag.

DETAILED DESCRIPTION OF THE PREFERRED EMBODIMENTS

Figure 2:
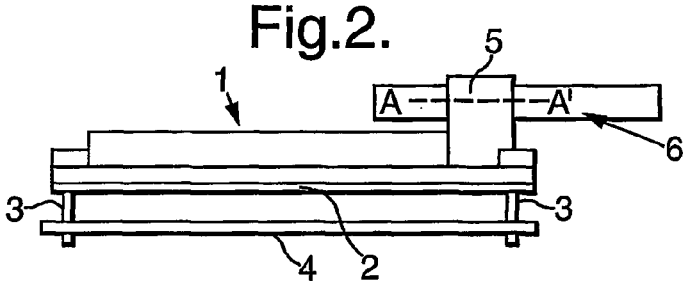
FIG. 2 is a side view of the security tag of FIG. 1.

FIGS. 1 and 2 show a security tag according to the present invention. As shown, the security tag includes a housing 1 with an attached mounting pad 2. The housing 1 may carry a security device such as a hologram or kinegram. Provided at respective locations around the perimeter of the housing 1 are four one shot fixings 3, such as rivets, or the like, which can be used on one occasion only to attach the housing 1 to a mounting plate 4. Also attached to the housing 1 is a mounting 5 which is adapted to receive an attaching member or clamp 6 as shown.

The mounting is shown in more detail in FIGS. 3*a* and 3*b*. FIG. 3*a* shows a cross-section of the mounting along the line A–A' shown in FIG. 2, whilst FIG. 3*b* shows a cross-section of the mounting 5 along the line B–B' shown in FIG. 1. The mounting includes two channels 7*a*,7b each of which is designed to receive a respective arm 6*a*, 6*b* of the attaching member 6. Each channel 7*a*,7*b* includes a number of springs 8 which are designed to urge the arms 6*a*,6*b* of the attaching member 6 against the upper side of the respective channel. The shape of the springs is such that the arms 6*a*,6*b* are only able to move through the channels in the direction shown by the arrow 9.

Accordingly, in use the attaching member 6 may be inserted into the mounting 5 in the direction shown by the arrows 9. However, it is impossible to extract the attaching member 6 in the reverse direction. Accordingly, the attaching member 6 can only be removed from the mounting 5 by physically breaking the attaching member and then drawing each of the arms 6*a*,6*b* through the respective channels 7*a*,7*b* independently. As a result, the attaching member 6 can be used to attach the housing to fabric type objects, as will be explained in more detail below.

A cross-sectional view of the inside of the housing is shown in FIG. 4. As shown, the housing is formed from a tough, anti-tamper laminated layer 10 formed from a lamination of rubber and high strength reinforced plastic which provides sufficient impact resistance to protect the internal components of the security tag even under extreme attack conditions.

Positioned inside the housing 1 is a printed circuit board (PCB) 11 on which are mounted the electronic components required to operate the tag. The PCB 11 is generally mounted in a layer of impact absorbing material 12 such as sponge, rubber or the like, to provide further impact resistance. In this example, a piezoelectric film 13 is positioned on the inside of the laminated layer 10, with a protective film 14 being positioned between the piezoelectric film 13 and the impact absorbing material 12.

A conductive external elastomeric coating may also be provided on the outside of the laminated layer 10, as shown by the dotted line 15.

Finally, a portion of the PCB 11 can also be contained within a metal can 16 which acts as a Faraday cage to protect the electronic components on the PCB from an EMP attack. It should be noted that in this case, sensors typically have to be located on the PCB 11 outside the metal can 16 in order to function correctly. Accordingly, surge arresting devices would be attached to these external sensors.

A schematic diagram showing the arrangement of the components mounted on the PCB 11 inside the housing 1 is shown in FIG. 5. As shown, the security tag typically includes a microprocessor 20, a radio transceiver 21 and a store 22 coupled together via a bus 23. Also coupled to the bus 23 are a number of sensors 24. These components are all powered from an on-board power supply 27.

In this example, five sensors 24 are shown although, as will be appreciated from the description below, more sensors will be required in certain circumstances. Each of these sensors form part of a sensing system which is used to monitor the status of the security tag and the items to which the security tag is attached.

Signals detected by the sensors are transferred to the processor 20 which is adapted to monitor the signals and determine when these indicate that the security tag and/or the items are being tampered with. Sensitivity of the measurement is set to a level which prevents the processor 20 determining that normal handling constitutes tampering but low enough so that tampering can be detected before the security tag, items or the like, become damaged. This can be done in one of two ways:

i. By analysis of the signals; or, ii. By comparing the signals to predetermined thresholds.

In the first example, the processor can be formed from a neural net. In this case, the neural net is trained under normal operating circumstances so that it learns what signals should be obtained from the sensors 24 when the security tags and items are being handled correctly. As a result, when signals outside the expected range are sensed then the processor determines that either the security tag or the items are being tampered with.

In the second example, an indication of the range of acceptable signals that should be obtained from each sensor 24 is stored in the memory 22. Accordingly the processor 20 can compare the obtained signals to the respective range of acceptable signals, and from this determine whether the items or security tag are being tampered with.

When any tampering is detected, the processor 20 is adapted to transfer a signal via the transceiver 21 to a remote monitoring system 26 indicating that the security tag or the items are under attack, as will be explained in more detail below.

In use, the security tag includes a large number of different security features which may be used separately or together in combination depending on the circumstances. The security features will now be explained below with reference to FIGS. 6 and 7.

FIG. 6 shows how the security tag is connected to a sealed container 30. As shown, the security tag is fitted to the body 32 of the container by placing the mounting pad 2 on a surface 31. The mounting pad 2 is formed from a tamper evident double sided adhesive pad which allows the housing 1 to be attached to the surface 31. The pad is designed so that if an attempt is made to remove the housing 1 from the surface 30, at least a portion of the pad will remain on the surface 30, whilst a corresponding portion will remain attached to the housing 1, thereby showing that a tag has been removed.

In addition to this (or optionally as an alternative), the one shot fixings 3 are inserted through the container body 30 and attached to the mounting plate 4 as shown, thereby securing the security tag in place.

An example of attaching the security tag to a fabric bag is shown in FIG. 7. In this example, the fabric bag 40 is attached to the security tag using the attaching member 6. The attaching member 6 is wrapped around the neck of the bag 40 and then the arms 6*a*,6*b* are inserted into the mounting 5. The arms 6*a* and 6*b* are then pulled into the channels 7*a*,7*b* as far as possible thus preventing removal of the security tag from the fabric bag 40.

Operation of the security tag will now be described. The security tag includes 3 different types of sensing mechanism, namely:

i. A housing sensor system to check the integrity of the housing;

ii. An attachment sensor for checking the integrity of the attachment to the container; and, iii. An item sensor for checking the integrity of the container containing the items.

Each of these will now be described below.

Housing Sensor

The housing sensor system is used to detect the integrity of the housing 1. This is carried out to prevent the security tag being tampered with to destroy the internal workings.

In a first example, the housing sensor system is formed from the piezoelectric film 13 and a corresponding one of the sensors 24. In this case, the sensor 24 is a current sensor, such as an ammeter or the like, which is adapted to detect electric currents generated in the piezoelectric film 13.

Accordingly, if the laminated layer 10 is deformed, for example by an attempt to crush or pierce the housing, this will cause corresponding deformation of the piezoelectric film 13. This will cause the generation of a current within the film which can be detected by the sensor 24.

As mentioned above, the sensor 24 is coupled to the processor 20 which monitors the signals obtained therefrom and determines whether these are representative of the housing being tampered with.

Thus, in general, a certain amount of current will be detected by the sensor 24 in normal operation, such as for example if the housing 1 is knocked during transit. However, if the current detected exceeds a threshold, and this is indicative of the fact that someone is attempting to open the housing 1, then this is detected by the processor 20 which causes a signal to be transferred via the transceiver 21.

In an alternative example, the sensor 24 can be adapted to measure the conductivity of the elastomeric coating 15. In general, the elastomeric coating will have a conductivity which can be measured by a sensor 24. This can be achieved for example by fabricating the sensor to apply a potential across the coating and to measure the current flow through the coating. The tag electrometric coating will contain a conductive compound such as graphite or compounds that consist of fine granules that can be added to the elastomer during compounding (manufacture). This coating can then be monitored in the same way as the strap. In this case, if the elastomeric coating 15 is interfered with, for example if it is pierced, this will change its conductivity, which will be detected by the processor 20 so that an appropriate response can be generated.

Attachment Sensor

The attachment sensor can be implemented in any one of a number of ways.

In a first example, a piezoelectric film (not shown) is sandwiched between the mounting pad 2 and the housing 1. Accordingly, if an attempt is made to remove the housing 1 from the surface 31 of a container, this will deform the piezo-electric film. The piezoelectric film will in turn generate a current which is detected by a current sensor 24.

Again, a certain amount of current generation is to be expected in normal use, for example due to movement during transit. However, if the generated current exceeds a threshold, this will be detected by the processor 20 which determines that an attempt has been made to remove the security tag from the container 30.

In a second example, the piezoelectric film is replaced by a capacitive film (not shown). The sensor 24 is then adapted to measure the capacitance of the film by applying an RF field to the film and measuring the response of current flow through the film. In this case, any variation in the capacitance indicates that the properties of the film are being effected, which in turn indicates that the coupling of the housing 1 to the container 30 is being tampered with.

Similar results could also be obtained by replacing the piezoelectric film in the mounting pad with either a conductive film, or a number of fine wires. In each case, the conductivity of the film or wires would be measured by an appropriate sensor 24.

In a third example, a sensor 24 is connected to the one shot fixings 3. In this case, the sensor 24 is used to monitor the electrical properties of the mounting plate 4. Thus, the system can operate to pass a current through the one shot fixings and hence through the mounting screws to allow the conductivity of the mounting plate 4 to be monitored.

This is preferably achieved by having the one shot fixings 3 form part of a transmission line with appropriate termination having the ability to change the capacitance and impedance as required. Once activated the tag will minimise the VSWR using a variable impedance and capacitive termination network allowing the tag to determine any alteration in the properties of the transmission line using an appropriate sensor 24.

In this example, if either the one shot fixings 3 or the mounting plate 4 are tampered with, a change in conductivity will be detected using the sensor 24 and again this will be signaled to the processor 20.

Finally, the attaching member 6 is generally formed from a conducting material. Accordingly, a sensor 24 is coupled to the channels 7*a*,7*b* to detect the conductivity of the attaching member. If the conductivity changes are more than a predetermined threshold amount, then this is detected by the microprocessor 20 which determines that the attaching member is being interfered with.

Again the attaching member 6 could be formed from a piezoelectric material which would then be coupled to an appropriate sensor 24.

Item Detection

Means for detecting whether the items have been disturbed can also be provided. In the case in which the security tag is attached to a metal container (for example as shown in FIG. 6), the conductivity of the container can be measured using one of the sensors 24. Again, a change in conductivity can indicate that the container has been opened in which case this will be detected by the processor 20.

In the case of a fabric bag 40 (FIG. 7) the fabric material can have conducting wires interwoven within the fabric. In this case, a sensor 24 can be attached to the fabric material via the conducting attaching member 6. The conductivity of the fabric can then be measured so that if the fabric is ripped in an attempt to extract items from the bag 40, this will be detected by the sensor 20.

Such a sensing technique could be improved by utilising two independent sets of wires which run in perpendicular directions. The conductivity of each set could be measured separately using two sensors 24, allowing variations that only effect the bag in a single direction to be detected.

Optionally, the items contained within either the container 30 or the bag 40 may have sensing means attached to them. This could take the form, for example, of part of a tuned inductive circuit. The first part of the inductive tuned circuit will consist of the sensor 24 whilst the second part will consist of suitable electronics attached to the item(s) within the container. Accordingly, the proximity of the two portions of the tuned circuit will affect the strength of a signal detected by the sensor 24 and relayed to the processor 20. This allows the processor to determine the proximity of the item(s) to the sensor 24 and hence determine if the item(s) are moved more than a predetermined distance from the security tag.

As a further option, piezoelectric films can be embedded in the packaging film of banded packs of banknotes 40 (FIG. 8). The banding will be provided in two wide strips 41,42 extending about the middle of the long and short edges of the note respectively such that a single note cannot be removed without deforming the film, which can be detected by an appropriate sensor 24 of a tag 43 secured to the films, in a manner similar to those described above (FIG. 6). Similar conductive techniques can be used and the security tag can be wired to the items as appropriate.

General Operation

In use, the security tag is attached either directly to an item of value or to a container 30 or bag 40 containing article(s) to be protected, in the manner described above.

Once this has been completed, details of the items to which the security tag is attached are supplied to the memory 22 of the security tag via the communications transceiver 21 from the host 26 or another input device (not shown). This can be achieved using, for example, a computing device such as a PDA, laptop, desktop computer, or the like, or a mobile communications device such as a WAP phone, depending on the nature of the communications transceiver.

In particular, if the transceiver is a Bluetooth piconet, a Bluetooth enabled PDA, WAP phone or the like, can be used to send a list of items to the memory 22 via the transceiver.

It is also possible to transfer an activation signal indicating to the processor 20 that it is to monitor the status of the sensors 24.

If at any time once the tag is activated the processor 20 determines that the signals from any one of the sensors 24 is outside the expected range, then the processor 20 determines that an attempt has been made to interfere with the item(s). Accordingly, the processor 20 generates an alarm signal which is transferred via the transceiver 21 to a remote control centre such as the host 26 or a security company, the police, a bank, or the like, which is responsible for the transfer of the money.

The alert signal is detected by the remote control centre which can determine that the items are being tampered with in some way.

In addition to this, the security tag may also send additional information, such as an indication of the sensor readings that are currently being obtained, thereby allowing the remote control centre to determine what is happening to the security tag.

Thus the security tag usually includes a location sensor 24 which is capable of determining the location of the security tag. This would usually take the form of a GPS satellite navigation type sensor which is capable of pinpointing the location of the security tag and transferring an indication of this to the remote control centre with any alarm signal. This allows the remote control centre to determine the location of the security tag at the time the interference took place, as well as at other times.

As an additional level of security, the processor 20 can be adapted to periodically send a status signal to the remote host confirming the current status of each of the sensors. This can allow the remote control centre to make their own observations regarding the integrity of the system, including the security tag's current location. Alternatively, the remote host can poll the system and request that the information be transferred as required.

In addition to this, because details of the items associated with the security tag are stored in the memory 22 this can allow the remote host to determine the value of the associated items.

For additional security the transfer of information from the processor 20 to the remote host 26 via the transceiver 21 can involve the encryption of the data prior to transfer using a conventional PKI system. This prevents a third party intercepting the signals from the security tag and then transmitting their own signals which indicate that the tag has not been interfered with when the tag is in fact sending alarm signals.

It will be appreciated from this that the tag can be used to secure documents for both identification and transfer purposes. Accordingly, an additional feature of the present invention is that the security tag can be used to transfer ownership of documents such as, for example cash.

In this case, once the documents have been securely coupled to the tag, for example by placing in a suitable container and attaching the tag to the container, the user can enter details of the items into the memory 22 in the usual way. The owner can also enter a transfer code which causes ownership of the documents (e.g. banknotes) in the container to be transferred to a third party.

Upon entry of such a transfer code, the processor 20 transmits information to the remote control centre to allow the transfer to be registered centrally. From this point on the documents are effectively owned by the transferee.

Accordingly, the documents can be left in their current physical location in the knowledge that they cannot be tampered with or interfered with without the transferee's authorization to shut down the security tag. The items can then be transferred to a different physical location at a later date if necessary.

Thus for example a shopkeeper may wish to deposit cash in a bank. Accordingly, the shopkeeper would fill a suitable bag with cash, enter the value in the memory 22 and then transfer ownership of the cash to the bank, using the above described technique. The cash can actually be left on the shop premises as its location is known from the security tag. The cash can then be physically transferred to the bank at a later date.

Alternatively, if before the cash is transferred the shop then requires cash for some reason, for example to pay a supplier, it is possible for the bank to transfer ownership of the cash back to the shop owner. The shop owner can then validly deactivate the security tag and access the cash which has never left the shop premises. However despite this the cash has in fact been for a period of time deposited in the shop owner's bank account allowing the shop owner to make transactions using this cash which in fact remains on the premises.

The invention claimed is:

1. A method of transferring the ownership of item(s), the method comprising:

a. Securely identifying the item(s) by attaching a security tag to the item(s), the security tag having a monitoring system for monitoring the tag status, the tag status indicating whether the security tag and/or the item(s) have been tampered with;

b. Detecting remotely the condition of the monitoring system; and c. Causing the remote host to register a change in ownership of the item(s) when the monitoring system does not indicate a tamper condition.

2. A method according to claim 1, wherein the security tag includes a housing, a securing mechanism for securing the housing to the item(s), the monitoring system for monitoring the tag status, the tag status further indicating at least whether the housing and the security mechanism have been tampered with, a store for storing item data, the item data identifying the item(s), and a communication system adapted to communicate the tag status and the item data to a remote host, the method comprising:

a. Attaching the security tag to the item(s);

b. Storing item data identifying the item(s) in the store; and, c. Monitoring the tag status and/or the item data from a remote host via the communication system.

3. A method according to claim 2, wherein step (a) further comprises the steps of:

i. Placing the items in a secure container; and, ii. Coupling the security tag to the secure container.

4. A method according to claim 3, wherein the monitoring system is adapted to monitor electrical properties of the secure container and wherein the method further comprises electrically connecting the monitoring system to the secure container.

5. A method according to claim 2, wherein the method of monitoring the tag status and/or the item data from a remote host comprises causing the communication system to communicate with the remote host system on at least one of the following occasions:

i. At predetermined time intervals ii. Upon request from the remote host system; or, iii. Upon a change in tag status indicating that the security tag and/or the item(s) have been tampered with.

6. A method according to claim 2, wherein the method further comprises monitoring the location of the security tag.

7. A method according to claim 1, wherein the item(s) are not physically transferred between owners in step (c).

8. A method according to claim 1, wherein the item(s) comprises an article of value such as a banknote and/or coin.

9. A method according to claim 8, wherein the item(s) is securely located in a container to which the security tag is attached.

10. A method according to claim 8, wherein the security tag is attached to a wrapper located about a stack of banknotes.

11. A method according to claim 1, further comprising communicating data identifying the item, to the remote host.

12. A method according to claim 1, wherein the remote host is caused to register the change in ownership in response to a transfer code being provided to the security tag by a user.

13. A method according to claim 1, further comprising transferring the ownership of the item(s) back to the original owner at a later time and when the monitoring system does not indicate a monitoring condition.

14. A method of transferring the ownership of item(s), the method comprising:

a. Securely identifying the item(s) by attaching a security tag to the item(s), the security tag having a monitoring system for monitoring the tag status, the tag status indicating whether the security tag and/or the item(s) have been tampered with;

b. Detecting remotely the condition of the monitoring system; and c. Causing the remote host to register a change in ownership of the item(s) when the monitoring system does not indicate a tamper condition, wherein the security tag includes a housing and a securing mechanism for securing the housing to the item(s).

* * * * *